US006507538B2

(12) United States Patent
Articola

(10) Patent No.: US 6,507,538 B2
(45) Date of Patent: Jan. 14, 2003

(54) ALARM CLOCK WITH WING-SHAPED SNOOZE CONTROL

(76) Inventor: Irene E. Articola, 5521 Whitley Park Ter., Bethesda, MD (US) 20814

( * ) Notice: Subject to any disclaimer, the term of this patent is extended or adjusted under 35 U.S.C. 154(b) by 101 days.

(21) Appl. No.: 09/822,410

(22) Filed: Apr. 2, 2001

(65) Prior Publication Data

US 2002/0141291 A1 Oct. 3, 2002

(51) Int. Cl.[7] ..... G04B 23/00

(52) U.S. Cl. ..... 368/263

(58) Field of Search ..... 368/72–73, 262–264, 368/243, 244

(56) References Cited

U.S. PATENT DOCUMENTS 3,039,260 A * 6/1962 Morrison et al.
3,109,280 A * 11/1963 Ring et al.
3,127,733 A * 4/1964 Robinson
4,213,291 A * 7/1980 Wooding ..... 368/263
4,747,087 A * 5/1988 Sakuma ..... 368/262

* cited by examiner

*Primary Examiner*—Vit Miska

(57) ABSTRACT

An alarm clock has a snooze feature, whereby the snooze feature has a wing-like shape. When the alarm goes off, the wing-like shape extends outwards from the alarm clock housing. By pushing the wing-shaped snooze feature back into the housing, the alarm goes off, and the snooze mode is entered. The extended wings may signify "time flies", at least while sleeping.

15 Claims, 3 Drawing Sheets

ALARM CLOCK WITH WING-SHAPED SNOOZE CONTROL

BACKGROUND OF THE INVENTION

A. Field of the Invention

The invention relates generally to alarm clocks, and, more particularly, to alarm clocks having a snooze feature.

B. Description of the Related Art

Alarm clocks are an important device in today's world. With people getting less and less sleep due to longer work hours, as well as other commitments, the need to be waken up at a particular time in the morning is very important.

As such, alarm clocks are utilized for waking people up, usually by emitting a loud sound, such as a buzzer sound, or by playing music from a selected radio station, at a time that is set by a user. For example, a user can set the alarm clock to go off at 7:00 a.m. At that time, the alarm will go off, and the only way to stop the alarm sound is to either hit a button or other control to cancel the alarm, or else to hit a snooze button to obtain a few more minutes of sleep. With the snooze feature, the alarm sound will stop, but it will begin again at a predetermined time from the hitting of the snooze button. For example, if the snooze button was hit at 7:00 a.m., the alarm would go off at that time, but it would go back on again at 7:07 a.m.

Most alarm clocks allow for multiple snoozes, whereby a person can hit the snooze button several times, each time gaining a few more minutes of sleep.

Typically, the snooze button is on the top surface of the alarm clock, making it readily accessible for a sleepy person to engage, to thereby turn the alarm sound off.

There currently exist several different types of alarm clocks, having different snooze button features. In U.S. Pat. No. 6,009,048 to Raesz, a novelty alarm clock is configured to look like a gambling slot machine, whereby it has a dome light that operates as a snooze push button.

In U.S. Pat. No. 4,730,284, an alarm clock is configured to appear like an animal, such as a rooster, whereby the alarm sound emanates from the sounding portion of the animal, such as the beak of the rooster. The alarm sound can be turned off by actuating the sounding portion, such as by pinching shut the beak of the rooster-shaped alarm clock.

The present invention is directed to a different type of structure for a snooze button or snooze control.

SUMMARY OF THE INVENTION

The present invention is directed to an alarm clock having a snooze button, wherein the snooze button is configured to have a wing-shape, and wherein the wing-shape is normally situated within an alarm clock housing when an alarm is not actuated, and wherein the wing-shape extends outwards from the alarm clock housing when the alarm is actuated. When the wing-shape is pushed back within the alarm clock housing, the alarm goes off, thereby resulting in a snooze actuation for the alarm clock.

BRIEF DESCRIPTION OF THE DRAWINGS

The foregoing advantages and features of the invention will become apparent upon reference to the following detailed description and the accompanying drawings, of which.

DETAILED DESCRIPTION OF SPECIFIC EMBODIMENTS

Preferred embodiments of the invention will be described in detail below, with reference to the accompanying drawings.

Figure 1:
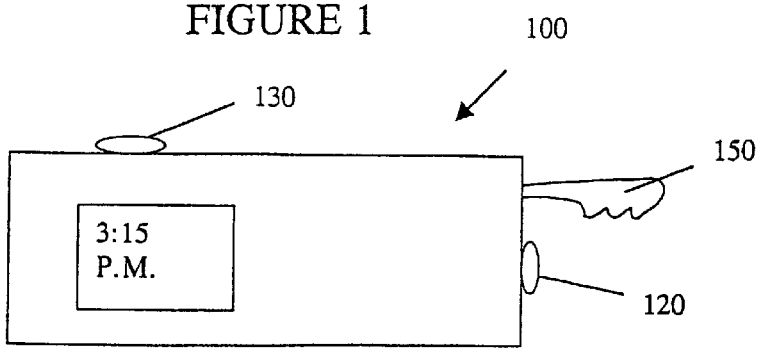
FIG. 1 is a diagram of an alarm clock having a wing-shaped snooze control, according to a first embodiment of the invention.

FIG. 1 shows an alarm clock according to a first embodiment of the invention. In FIG. 1, an alarm clock 100 has a clock display portion 110, which typically is a digital display, such as an LED display. The present invention is applicable to other types of displays, such as analog displays having an hours hand, a minutes hand, and a seconds hand (optional).

The alarm clock 100 may be configured to operate as a radio, so as to play a particular radio station that can be selected by the operator turning a tuning knob 120 to a particular AM or FM frequency. The alarm clock 100 may also be configured to play either sound from the selected radio station, or a preselected sound (such as a beeping sound), when an alarm mode is selected. The alarm clock 100 in FIG. 1 is shown having an alarm select button 130, which is disposed on the top surface of the alarm clock 100, but which may be alternatively disposed at another portion of the outer surface of the alarm clock.

The alarm clock 100 has a mode in which the user can then select a time at which he/she wants the alarm to go off. Details of this alarm selecting are known to those skilled in the art, and will not be described in detail. With the alarm time selected, and with the alarm select button 130 selected, the alarm clock is in an alarm mode, and will emit a sound (and/or a visual indication, if the alarm clock has such a feature) when the alarm time occurs.

The alarm clock 100 is shown having a wing-shaped snooze feature 150, which extends out from a slot on a side surface of the alarm clock when the alarm goes off. The wing-shaped snooze feature 150 is preferably shaped like a bird's wing, and preferably is made of plastic. With the wing-shaped snooze feature 150 extended, the operator can push the wing-shaped snooze feature 150 back into the alarm clock 100, to thereby turn off the alarm sound and to enter the snooze mode. With the snooze mode entered in such a fashion, the wing-shaped snooze feature 150 will extend outwards from the side of the alarm clock 100, and at the same time the alarm sound will go off, at a predetermined amount of time, e.g., 7 minutes, after the alarm first went off. This procedure can continue for a plurality of consecutive snooze times, to thereby allow the operator to gain additional sleep, but still have the alarm stay in the alarm mode.

Preferably, the wing-shaped snooze feature 150 is fitted within a slot on the side surface of the alarm clock 100, and is held in place in a normal, non-alarm mode of the alarm clock 100. When the alarm goes off, a retaining element within the alarm clock 100 moves in a particular direction to thereby allow the wing-shaped snooze feature 150 to extend outwards. The wing-shaped snooze feature can be spring loaded, whereby the spring pushes the wing-shaped snooze feature 150 outwards to its maximally extended position, when the retaining element is moved out of the way.

Figure 2:
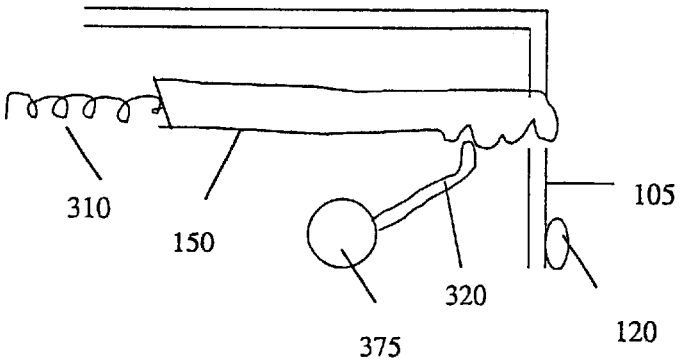
FIG. 2 is a diagram showing one possible configuration of elements for holding the wing-shaped snooze control within the housing of the alarm clock, during all non-alarm periods.

FIG. 2 shows one possible configuration for causing the wing-shaped snooze feature 150 to be held in the alarm clock housing at non-alarm times, and to extend outwards from the alarm clock housing at alarm times. A spring 310 pushes against the wing-shaped snooze feature 150, to thereby urge it to move in an outwards direction. A retaining element 320 keeps the wing-shaped snooze feature 150 within the housing, and is strong enough to withstand the pressure caused by the spring 310. The retaining element 320 is preferably a plastic part.

With the alarm goes off, the retaining element 320 moves downwards to thereby no longer be engaged with the wing-shaped snooze feature 150. The means to cause the retaining element 320 to move may be done by a variety of ways, such as a gear mechanism that rotates (in a clockwise direction for the configuration shown in FIG. 2) when the alarm goes off. FIG. 2 shows a gear mechanism 375 that is coupled to the retaining element 320. With the retaining element 320 out of the way, the wing-shaped snooze feature 150 extends outwards to its maximally-extended position, based on the non-counteracted force exerted by the spring 310. With the wing-shaped snooze feature 150 extended, the retaining element 320 moves upwards to its initial position. The means for causing the retaining element 320 to move back can be done by a variety of ways, such as an internal timer that, once timed out, causes the gear to rotate in an opposite direction with respect to the direction that caused the retaining element 320 to move out of the way.

Now, when the operator pushes the wing-shaped snooze feature 150 back inwards to within the housing of the alarm clock 100, the wing-shaped snooze feature 150 will engage the retaining element 320 at a particular portion of the wing-shaped snooze feature 150. This will hold the wing-shaped snooze feature 150 in place within the housing of the alarm clock 100. This process can repeat itself for as many snooze periods as desired.

Figure 3:
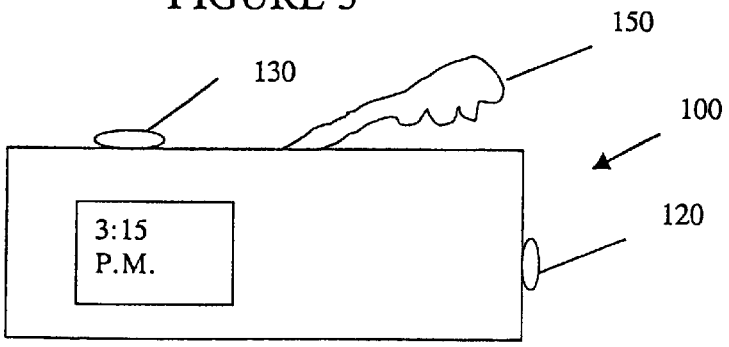
FIG. 3 is a diagram of an alarm clock having a wing-shaped snooze control in an extended position, according to a second embodiment of the invention.
Figure 4:
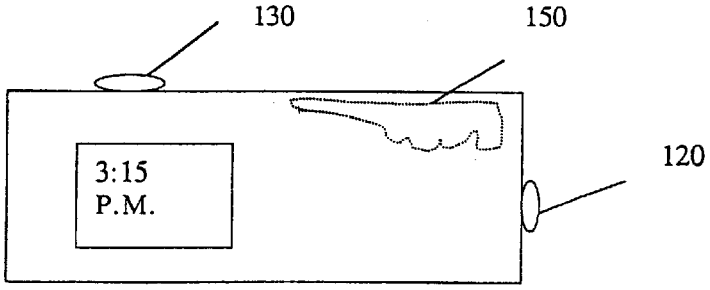
FIG. 4 is a diagram of the alarm clock according to the second embodiment of the invention, with the wing-shaped snooze feature in a non-extended position.

FIG. 3 shows a second embodiment of the invention, in which the wing-shaped snooze feature 150 extends outwards from a top surface of the housing of the alarm clock 100 when the alarm goes off. When pushed back down by the operator, the alarm goes off, and the snooze period begins. A retaining element such as shown in FIG. 3, or other type of retaining element, may be utilized, while remaining within the scope of the invention as described herein. FIG. 4 shows the wing-shaped snooze feature 150 according to the second embodiment, in its down, or non-alarm position, within the housing of the alarm clock. When the alarm goes off, the wing-shaped snooze feature 150 extends outwards from a slot (not shown) on the top surface of the alarm clock 100. Thus, in the second embodiment, the wing-shaped snooze feature 150 extends outwards due to its rotating upwards from a home position to an alarm position. The method of rotating may be by way of a pivot point at which a proximal end of the wing-shaped snooze feature 150 is attached to the alarm clock 100 (within the housing of the alarm clock 100), or by other suitable ways.

Figure 5:
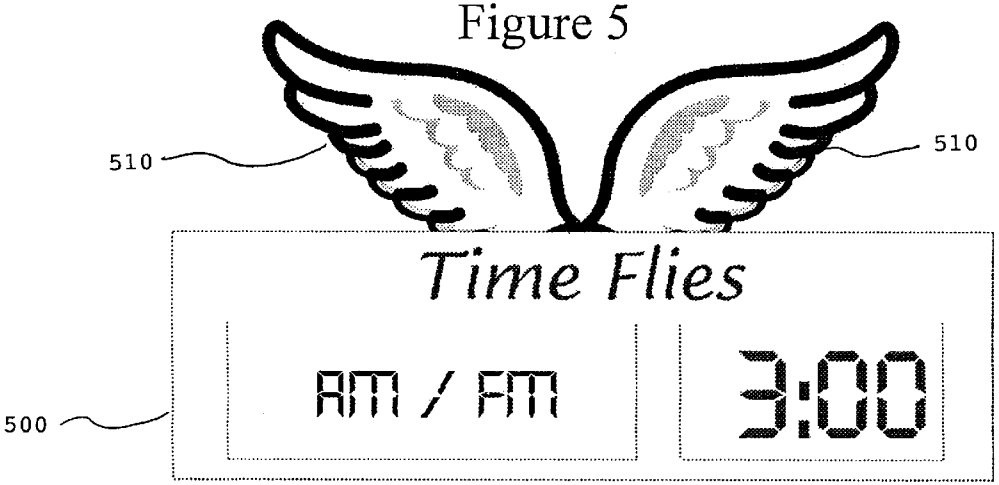
FIG. 5 is a diagram of a two-wing alarm clock, according to a third embodiment of the invention.

FIG. 5 shows a two-wing configuration of an alarm clock 500 according to a third embodiment of the invention. In the third embodiment, the two wings 510 extend from left and right portions of the top surface of the alarm clock 500 when the alarm goes on. When the operator pushes down one of the wings in order to turn off the alarm to thereby enter the snooze mode, the other wing will retract back into the alarm clock housing as well.

Figure 6:
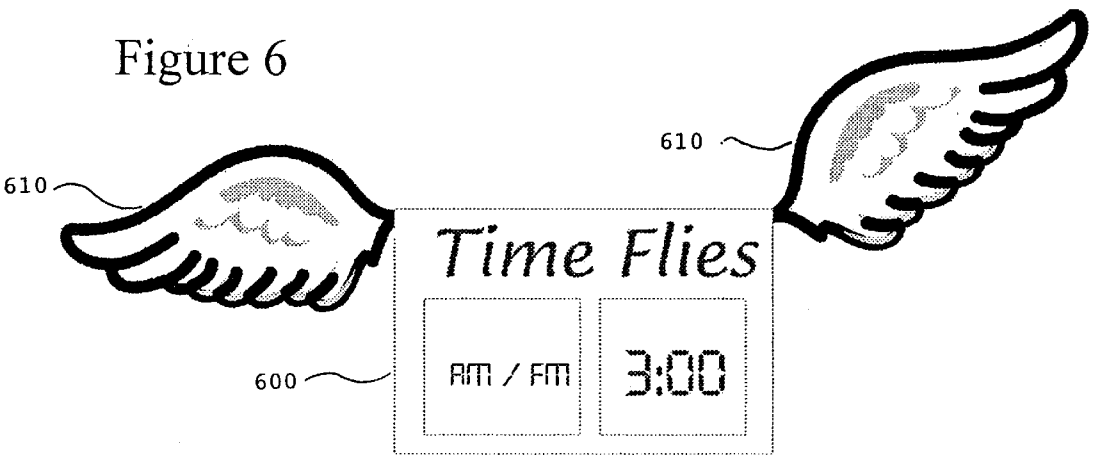
FIG. 6 is a diagram of a two-wing alarm clock, according to a fourth embodiment of the invention.

FIG. 6 shows a two-wing configuration of an alarm clock 600 according to a fourth embodiment of the invention. In fourth embodiment, the two wings 610 respectively extend from slots on the left and right side surfaces of the alarm clock 600 when the alarm goes on. When the operator pushes down one of the wings in order to turn off the alarm to thereby enter the snooze mode, the other wing will retract back into the alarm clock housing as well. FIG. 6 shows the two wings 610 pivoted to a top left and top right corner of the alarm clock, respectively, whereby they pivot back within the alarm clock housing when pushed downwards by an operator. Alternatively, the "slot" configuration, whereby the wings 610 exit the side surfaces in a manner such as shown in FIG. 2, may be utilized with the fourth embodiment.

Figure 7:
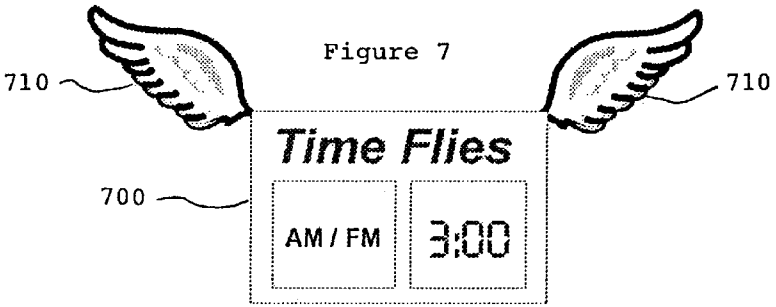
FIG. 7 shows a two-wing alarm clock with the wings in the fully-extended position, according to a fifth embodiment of the invention.

A fifth embodiment of the invention will now be described in detail. FIG. 7 shows a two-wing alarm clock 700 according to the fifth embodiment, with the wings being shown in a fully-extended position. In the fifth embodiment, the wings 710 gradually extend outwards, starting from a time which the alarm is set, and ending at a time which the alarm goes off. For example, if at 8:00 p.m. the user sets the alarm clock 700 to go off at 6:00 a.m. the next morning, there is a 10 hour time period between the time the alarm was set (8:00 p.m.) and the time that the alarm will go off. During this 10 hour time period, the wings 710 of the alarm clock 700 gradually extend outwards. Thus, in the example given above, at 8:00 p.m., the wings 710 are in a fully-retracted position, as shown in FIG. 7. This fully-retracted position is shown with the wings 710 folded down, but still visible on the sides of the alarm clock 700. Of course, the fully-retracted position could alternatively correspond to the wings 710 being disposed within slots inside the housing of the alarm clock 700, whereby the wings 710 would not be in view in their fully-retracted position (see FIG. 2, for example).

Figure 8:
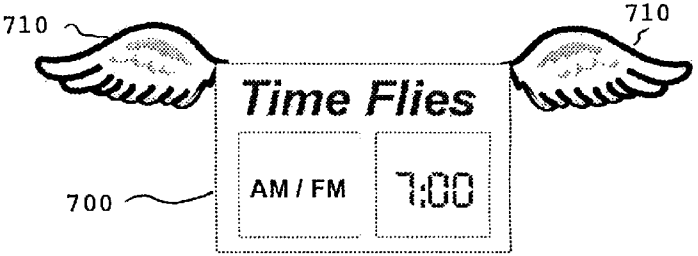
FIG. 8 shows the two-wing alarm clock according to the fifth embodiment of the invention, with the wings in a half-extended position.
Figure 9:
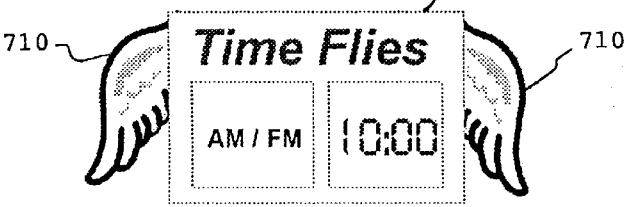
FIG. 9 shows the two-wing alarm clock according to the fifth embodiment of the invention, with the wings in a fully-retracted position.

Either way, the wings would extend outwards as the time elapses and slowly approaches the alarm going off time. In the example given above, the wings could extend in five stages, starting at a fully-retracted position, then going to a ¼-extended position, then going to a ½-extended position, then going to a ¾-extended position, and then going to a fully-extended position. FIG. 8 shows a ½-extended position of the wings 710, and FIG. 9 shows a fully-extended position of the wings 710. In the five-stage configuration, the 10-hour time period between alarm setting and alarm going off, would be divided up into four periods, with the wings extending at the end of each period. Thus, 10 divided 4=2.5, and at 8:00 p.m.+2½ hours=10:30 p.m., the wings would move from their fully-retracted position to their ¼-extended position. At 10:30 p.m.+2½ hours=1 a.m., the wings would move from their ¼-extended position to their ½-extended position (see FIG. 8 position). At 1 a.m.+2½ hours=3:30 a.m., the wings would move from their ½-extended position to their ¾-extended position. Lastly, at 3:30 a.m.+2½ hours=6 a.m., the wins would move from their ¾-extended position to their fully-extended position (see FIG. 9 position), and the alarm would go off at this time as well.

The gradual moving of the wings allows a user to easily determine, during the night when that person wakes up to do something (such as go to the bathroom or get a drink of water), the extent of the wing displacement, so as to get a quickly discernible indication as to how soon the alarm will go off. This can be done without having to look at the actual time, which may be a useful feature for people with bad vision, who cannot readily discern, without having to put on their glasses, the time indication on the alarm clock.

Once the alarm goes off, and the user pushes the wings back to their fully-retracted position to enter the snooze mode, the wings will stay in their fully-retracted position for the duration of the snooze period (e.g., 7 minutes), and then fully extend when the snooze period expires (with the alarm going off at the same time).

Of course, the number of steps in which the wings would move outwards can be any number, based on manufacturing considerations and the like. For example, a 10-step-increment of wing extension movement can be utilized, while remaining within the scope of the invention. Also, while the fifth embodiment was described with respect to a dual-wing alarm clock, it is equally application to a single-wing alarm clock, whereby the wing may be disposed on the side surface or on the top surface of the alarm clock.

In an alternative configuration of the third embodiment, the wings 710 may be glow-in-the-dark (e.g., neon) wings, to allow someone to more readily see the wings 710 at night (such as when that person is going to get a glass of water or going to the bathroom).

Thus, different embodiments of an alarm clock having a wing-shaped snooze control have been described according to the present invention. Many modifications and variations may be made to the techniques and structures described and illustrated herein without departing from the spirit and scope of the invention. Accordingly, it should be understood that the apparatuses described herein are illustrative only and are not limiting upon the scope of the invention.

What is claimed is:

1. An alarm clock comprising:

a housing for the alarm clock; and a wing-shaped snooze control that extends outwards from the housing when an alarm occurs, wherein substantially all of the wing-shaped snooze control is disposed within the housing before extending outwards when the alarm occurs.

2. The alarm clock according to claim 1, wherein the wing-shaped snooze control extends from a side surface of the housing.

3. The alarm clock according to claim 1, wherein the wing-shaped snooze control extends from a top surface of the housing.

4. The alarm clock according to claim 1, further comprising:

a pushing element that urges the wing-shaped snooze control to move in a direction outwards with respect to the housing of the alarm clock; and a retaining element that holds the wing-shaped snooze control within the housing when the alarm does not occur, and which counteracts the force exerted by the pushing element to maintain the wing-shaped snooze control within the housing, wherein the retaining element moves in a direction away from the wing-shaped snooze element to allow the pushing element to urge the wing-shaped snooze element to extend outwards from the housing of the alarm, when the alarm occurs.

5. The alarm clock according to claim 2, further comprising a second wing-shaped snooze control, wherein the second wing-shaped snooze control extends from an opposite side surface of the housing.

6. The alarm clock according to claim 3, further comprising a second wing-shaped snooze control, wherein the second wing-shaped snooze control extends from the top surface of the housing.

7. The alarm clock according to claim 1, further comprising:

means for computing a first time when the alarm is set by a user, and a second time when the alarm is to go off; and means for incrementally extending the wing-shaped snooze control based on an elapsed time from the first time, with respect to the second time.

8. The alarm clock according to claim 7, wherein an amount of the wing-shaped snooze control extending out from the housing provides a visual indication to the user as to approximately when the alarm is to go off.

9. The alarm clock according to claim 7, further comprising:

visual highlighting means provided on the wing-shaped alarm, to thereby provide the user with a visual indication of the wing-shaped alarm in a dark environment.

10. The alarm clock according to claim 9, wherein the visual highlighting means corresponds to a neon element provided on an outer surface of the wing-shaped alarm.

11. An alarm clock comprising:

a housing for the alarm clock, the housing including a top surface and side surfaces; and a wing-shaped snooze control that has a first end and a second end and that is pivotably connected by way of a pivot point at the first end to the housing, wherein, prior to a time when an alarm is to go off, the first end and the second end of the wing-shaped snooze control are disposed within the housing, and wherein, when the time when the alarm is to go off, the wing-shaped snooze control pivots on the pivot point to cause the second end of the wing-shaped snooze control to extend out from the housing so as to be viewable by a user and so as to be manipulatable by the user.

12. The alarm dock according to claim 11, further comprising:

means for computing a first time when the alarm is set by a user, and a second time when the alarm is to go off; and means for incrementally extending the wing-shaped snooze control based on an elapsed time from the first time, with respect to the second time.

13. The alarm clock according to claim 11, wherein an amount of the wing-shaped snooze control extending out from the housing provides a visual indication to the user as to approximately when the alarm is to go off.

14. The alarm clock according to claim 11, further comprising, visual highlighting means provided on the wing-shaped alarm, to thereby provide the user with a visual indication of the wing-shaped alarm in a dark environment.

15. The alarm clock according to claim 14, wherein the visual highlighting means corresponds to a neon element provided on an outer surface of the wing-shaped alarm.

* * * * *